United States Patent [19]

Hoffschmidt

[11] 3,967,375

[45] July 6, 1976

[54] RAZOR CONSTRUCTION

[76] Inventor: Edward J. Hoffschmidt, Harpsichord Turnpike, Stamford, Conn. 06903

[22] Filed: Mar. 3, 1975

[21] Appl. No.: 554,548

Related U.S. Application Data

[63] Continuation of Ser. No. 335,447, Feb. 26, 1973, abandoned.

[52] U.S. Cl. ..... 30/47; 30/86; 206/228

[51] Int. Cl.[2] ..... B26B 21/52; B65D 81/00

[58] Field of Search ..... 30/32, 47, 62, 64, 85, 30/86; 16/16 A; 206/228

[56] References Cited

UNITED STATES PATENTS

| | | | |
|---|---|---|---|
| 919,719 | 4/1909 | Hart | 30/62 X |
| 2,664,625 | 1/1954 | Koughnet | 30/86 X |
| 3,388,831 | 6/1968 | Hansom | 30/40.2 X |
| 3,409,982 | 11/1968 | Baker | 30/47 |
| 3,646,674 | 3/1972 | Fitzpatrick | 30/64 |

*Primary Examiner*—Al Lawrence Smith
*Assistant Examiner*—Gary L. Smith
*Attorney, Agent, or Firm*—Hopgood, Calimafde, Kalil, Blaustein & Lieberman

[57] ABSTRACT

The invention contemplates a razor-handle construction of such elemental simplicity as to be fabricated as a single integral molded-plastic part, with end-lug formations contoured to removably receive and assemble to the central region of the back-edge of certain razor-blade subassemblies, including presently commercial subassemblies. In the disclosed embodiments, the handle is a sheath in which the razor-blade subassembly is self-packaged and readily accessible for assembly to the lug formations, being then correctly oriented for use.

10 Claims, 13 Drawing Figures

RAZOR CONSTRUCTION

This is a continuation of application Ser. No. 335,447, filed Feb. 26, 1973, now abandoned.

The invention relates to a knocked-down safety-razor construction wherein the straight cutting edge of a blade is correctly mounted and held for use.

It is an object of the invention to provide an improved construction of the character indicated.

Another object is to provide such a construction in which a blade element is stored in the handle, ready for assembly and use.

A further object is to provide such a construction, applicable to commercially available blade subassemblies or to present blade-subassembly techniques.

A specific object is to meet the foregoing objects with a single-piece handle construction which is both the storage device for the blade subassembly and the means for mounting the blade subassembly for use.

A general object is to achieve the ultimate in economy and simplicity of razor construction, whereby the complete razor may be economically discarded after use, or may be stored so compactly as to require negligible pocket or other carrying space.

Other objects and various further features of novelty and invention will be pointed out or will occur to those skilled in the art from a reading of the following specification, in conjuction with the accompanying drawings. In said drawings, which show, for illustrative purposes only, preferred forms of the invention:

In FIGS. 1 to 5, the invention is shown in application to a safety-razor kit comprising a blade-subassembly member 10 and a handle-casette member 11.

Figures 1, 2, 3, 4, 5, 6, 7, 8, 9, 10, 11:
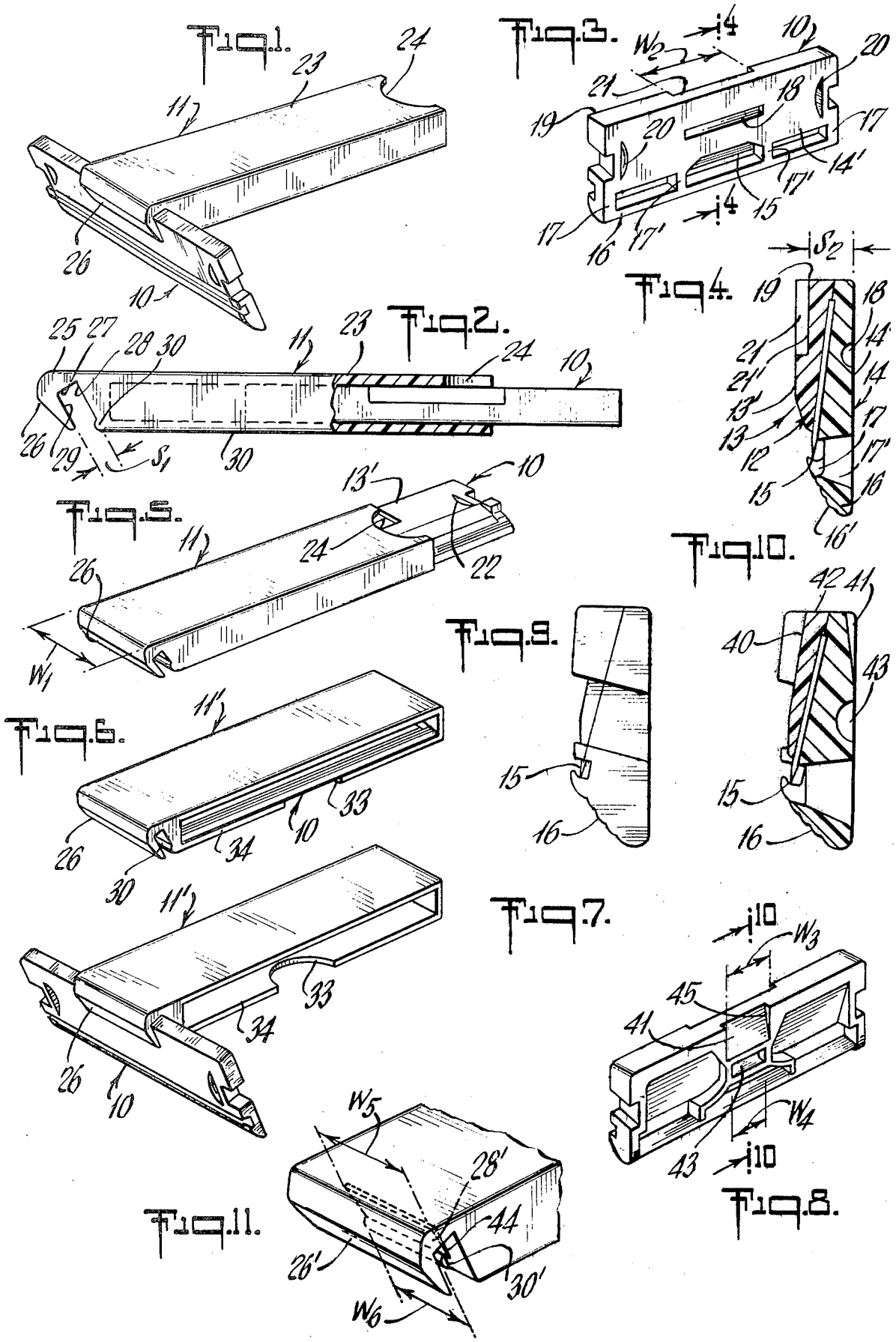
FIG. 1 is a perspective view of an assembled razor of the invention.
FIG. 2 is a partly broken-away view in side elevation of the razor of FIG. 1.
FIG. 3 is a perspective view, from the rear, of the razor-blade subassembly for the razor of FIG. 1.
FIG. 4 is an enlarged sectional view, taken at 4—4 in FIG. 3.
FIG. 5 is a perspective view of another assembled arrangement of the components of FIG. 1.
FIG. 6 is a view similar to FIG. 5 for a modified construction.
FIG. 7 is a view similar to FIG. 1, for the modification of FIG. 6.
FIG. 8 is a view similar to FIG. 3, for a different razor-blade subassembly.
FIGS. 9 and 10 are enlarged views, to the same scale, being respectively an end elevation and a section taken at 10—10 in FIG. 8, for the razor-blade subassembly of FIG. 8.
FIG. 11 is a fragmentary perspective view of the blade-mounting end of a handle member for the razor-blade subassembly of FIG. 8.

The subassembly 10 may be said to be generally rectangularly prismatic, being shown in detail in FIG. 4 to comprise a permanently bonded assembly of a blade element 12, between molded-plastic mounting elements 13–14, whereby the straight cutting edge 15 of the blade 12 is positioned free of the plastic mounting-body parts and close to the general plane of the front face 13' of mounting element 13. Beyond and offset from the cutting edge 15, an integral guard-bar formation 16 is positioned by outer and inner bridge connections 17—17' from the main body of the rear mounting element 14; longitudinal ribs or flutings 16' on the outer exposed generally arcuate face of bar 16 will be understood to provide a skin-sweeping and stretching function immediately preceding and in the path of razor-blade action. Finally, the rear face 14' of mounting element 14 is locally recessed at a longitudinally central location 18, near to but offset from the back edge 19 of the blade subassembly, and preferably, the rear face 14' further includes local recesses 20 for finger-nail engagement, as will later be clear; another recess or notch 21 in the front face 13' of mounting element 13 is longitudinally generally co-extensive with and opposite the recess 18, and it extends to the back edge 19, as shown in FIG. 4. Again, preferably, local end recesses, as at 22 (FIG. 5), in the front fact 13' provide finger-nail access.

The handle or casette 11 is preferably a single injection-molded piece of plastic, having a hollow generally rectangularly prismatic interior accommodating the length, width and thickness dimensions of the razor-blade subassembly 10. In FIGS. 1, 2 and 5, the hollow interior is open at one longitudinal end of handle 11, and the upper wall 23 of handle 11 is recessed or cut-away (at 24) at said end, for direct fingernail access to one of the blade-assembly recesses 20–22 already described.

At its other longitudinal end, the handle member 11 integrally includes a hook-shaped lug formation, preferably extending substantially the full effective width dimension $W_1$ of the handle 11 and characterized by an outwardly extending body portion 25 and a downwardly projecting retainer portion 26; dimension $W_1$ is such as to be received in the longitudinal extent $W_2$ of recess 21. The inner contour of the hook formation is characterized by a flat inclined bottom face 27, to receive seated engagement of the back edge 19 of the blade subassembly 10; and adjacent faces 28–29 are oriented for coaction with the rear face 14' and with the wall 21' of recess 21, respectively. An integral rib 30, in substantially the plane of the bottom panel 31 of the handle member 11, projects to close the open span of the hook formation and is substantially co-extensive with the recess 18, for locating fit therein. Preferably, the downwardly projecting hook end 26 is tapered and stiffly resilient, the inner face 29 converging toward face 28; in its unstressed condition, the hook end is spaced a distance $S_1$ from the plane of face 28, said distance being less than the local effective thickness $S_2$ of the back-edge region 21'-19-14'.

When manufactured, stored or carried, the parts are in the assembled relation suggested in FIGS. 2 and 5, wherein the blade subassembly is fully received or receivable in the interior of handle member 11. For shaving use, fingernail access at one of the recesses 20–22 is sufficient to overcome any retaining frictional interference between the parts, for endwise removal of the blade subassembly 10. Edgewise insertion of the central part of the back-edge region 21'-19-14' into the open end of the hook formation forces transient resilient outward bending deformation of projection 26, until rib 30 locates in recess 18, and the parts snap into the relationship of FIG. 1, in readiness for shaving. After shaving, the blade subassembly may be washed clean and disassembled, for return to the protection of casette-storage in handle 11, in readiness for the next use; alternatively, all parts may be simply discarded.

In the arrangement of FIGS. 6 and 7, the blade-subassembly and lug formation 26 (and its internal contouring) are as described for FIGS. 1 to 5 and are therefore given the same reference numbers. The point of difference is that the hollow interior of the handle member 11' is open to a longitudinal edge side thereof, and a finger-access recess 33 is cut from the bottom panel 34, along the edge-access opening. Recess 33 is deep enough to permit fingernail access to recess 18 or to guard 16, depending on the orientation of the blade subassembly when inserted into the storage interior of handle member 11'. In shaving use, the recess 33 provides the additional function of finger location, for better grasp and manipulation of the handle.

The blade subassembly of FIGS. 8 to 10 is precisely that of a form commercially available in today's market place; it includes many elements and features already described in connection with FIGS. 3 and 5, and lug formations 25'-26'-30' of a handle-casette (FIG. 11) of the invention may be designed to accommodate and mount such a commercial product. In this commercial product, the longitudinally central parts 40–41 of the front and back faces near the back edge 42, are slightly convergent, as shown in FIG. 10, the back face part 41 being a recessed or ramp panel, of extend $W_3$ less than the extents $W_1$ and $W_2$ previously noted. The recessed panel 41 extends to substantial adjacency with a locking recess 43, corresponding to recess 18 (FIG. 3) but of still lesser extent $W_4$. Blade (15) and guard (16) features are otherwise as already described.

To accommodate the indicated features of FIGS. 8 and 10, the contour within the hooked formation 25'–26' is specially characterized, so that the face 28' is of reduced extent $W_5$ for reception against the recessed ramp 41, and so that the rib projection 30' is of further reduced extent $W_6$, for reception in the recess 43. The shoulders 44 which define limits of face 28' have central locating abutment with the sides (45) of the recessed ramp 41.

Figure 12:
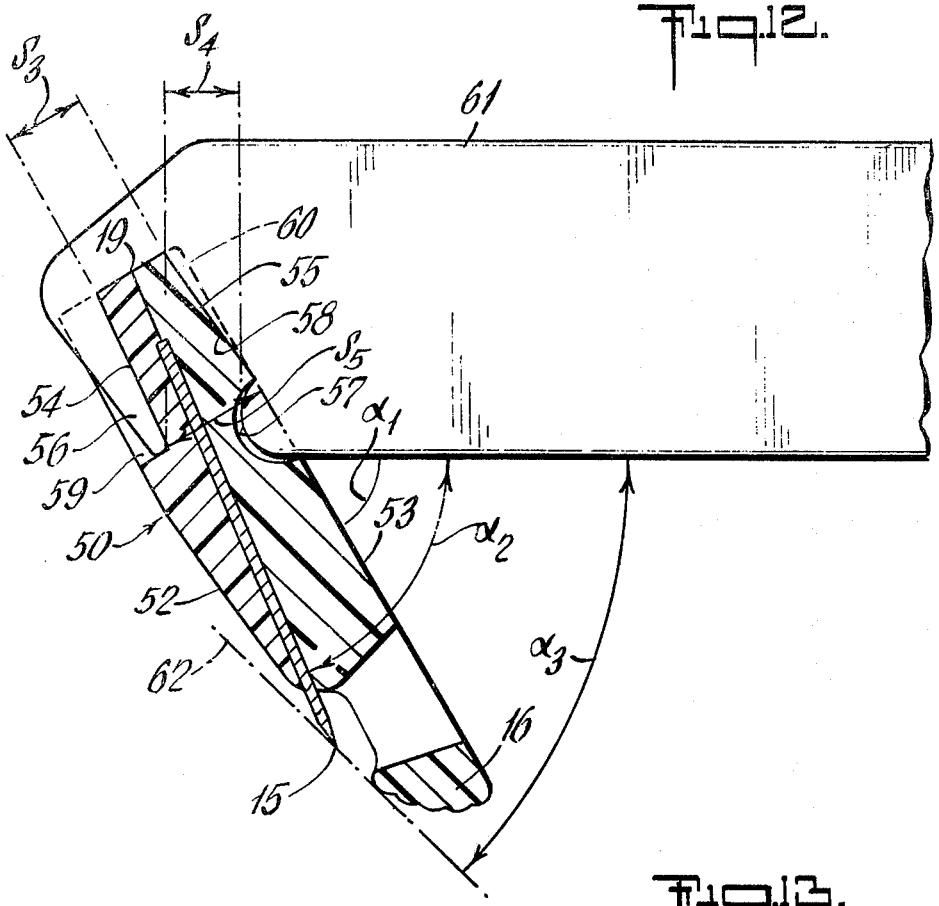
FIGS. 12 and 13 are much enlarged sectional views of assembled blade-to-handle relationships, for mounted accommodation of blade subassemblies similar to those of FIGS. 4 and 8, respectively.
Figure 13:
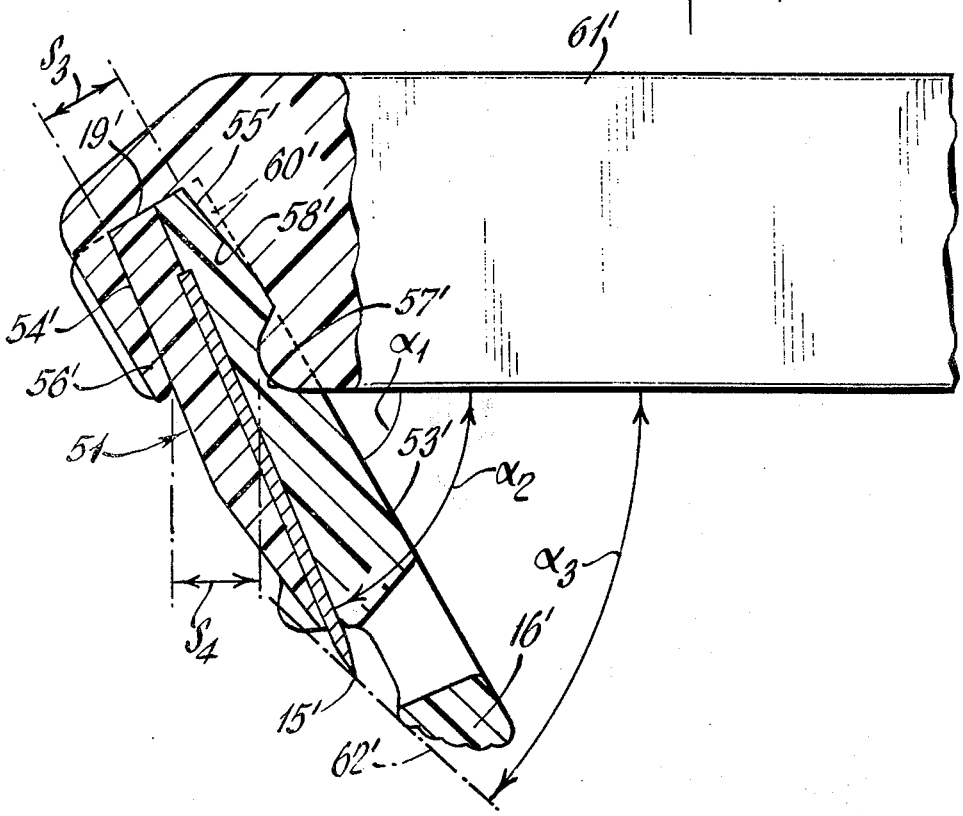

FIGS. 12 and 13 provide greater detail for the engaged relation of blade-subassembly and handle members, for a first blade subassembly 50 (FIG. 12) which is not presently on the market and for a second blade subassembly 51 (FIG. 13) representative of a present commercial product.

In FIG. 12, the front and back faces 52–53 are both locally recessed in the region of hook engagement, adjacent the back edge 19, to define hook-contour-engaging surfaces 54–55, which are preferably slightly convergent, as shown, and the effective back-edge thickness span $S_3$ is not substantially greater than the unstressed span $S_4$ between the hook end 56 and the locking projection 57, for ease of back-edge assembly to the hook; at the same time, the unstressed span $S_5$ between the hook end and the opposite hook contour face 58 is such as to assure a degree of resilient loading of the blade-assembled relationship shown. Preferably, the extent between shoulders 59–60 which define lateral limits of the faces 52–53, respectively, is such as to locate against corresponding side edges of the hook formations, for the full effective width of the handle member 61. Preferably also, the angular inclination of the hook contour is such as to support the blade subassembly at an acute angle $\alpha_1$ to the longitudinal direction of the handle 61, said angle $\alpha_1$ being intermediate the acute angle $\alpha_2$ of the blade and the more sharply acute angel $\alpha_3$ of handle orientation with respect to the locally shaved skin surface, the latter being shown as the line 62, tangent to edge 15 and guard 16. The arrangement is such that hook end 56 not only holds the surfaces 19–55 firmly to the hook contour, but hook end 56 will readily abut the lower end of recess 59 to develop a fulcrum, for ease of disassembling the element 50, upon clockwise rotation thereof to relieve locked engagement at 57.

The arrangement of FIG. 13 is the counterpart of FIG. 12, for the case of the commercially available structure 51. Orientation angles and parts relationships are much the same and therefore the same numbers are used, with primed notation. Engaged parts are shown in full section, because the engaged parts do not necessarily engage for the full width of the handle, as discussed and shown at $W_3$-$W_4$-$W_5$-$W_6$ in connection with FIGS. 8 and 11.

The described invention will be seen to have achieved all stated objects with elemental simplicity, effectiveness and economy. The economy is such as to make feasible the packaging, sale and/or sample distribution of individual razor blades or razor-blade kits, contemplating full disposal after use, or protected storage for reuse, as desired.

While the invention has been described in detail for the preferred forms shown, it will be understood that modifications can be made without departure from the scope of the claims.

I claim:

1. In combination, an elongated generally polygonally prismatic sheath having a hollow generally prismatic interior open to one of the sides of said sheath, the sectional extent of said open side being of at least the sectional extent of the interior to which access is had via said open side; and a razor-blade subassembly comprising blade means with and a rigid back permanently supporting said blade means with at least one elongate straight cutting edge positioned for a shaving cut, said back defining between front and back faces blade-mounting means at and adjacent to a back edge parallel to said cutting edge, the overall length, width and thickness dimensions of said subassembly substantially conforming to the length, width and thickness dimensions of the interior of said sheath, whereby the subassembly is removably insertable in said sheath via said open side; at least one of the longitudinal-end sides of said sheath being closed and including a hooked lug formation of width substantially coextensive with the width dimension of said sheath and defining a razor-mounting opening having an inner-wall contour integrally formed with one longitudinal-end side of said sheath and substantially matching the longitudinally central sectional contour of said subassembly at least at the region thereof which includes said back edge and at adjacent portions of said front and back faces, the outermost end of said lug formation defining with the opposed inner-wall contour a blade-clamping span which is no greater than the lug-overlapped local effective thickness of said back edge region when the back edge of said blade assembly is received in said hooked lug formation, said blade-mounting means and said lug formation having interengaging means detachably retaining their assembled relationship and including a centrally recessed front-face wall formation adjacent said back edge, the longitudinal extent of said recessed wall formation being substantially the effective width of that part of said lug formation which is engageable therewith, whereby the full effective width of the sheath itself provides relatively wide-based and stabilized support of said blade assembly when retained by said lug formation.

2. The combination of claim 1, wherein the projecting end of said lug formation is relatively more resiliently bendable than any other part thereof, said span in the unstressed condition being less than the said local effective thickness, whereby razor-blade subassembly to the lug formation of said sheath may be resiliently retained.

3. The combination of claim 1, in which said blade subassembly includes bonded blade-mounting means defining said back edge and adjacent portions of said front and back faces, said contour being such as to incline said blade means at an acute angle to the longitudinal direction of said sheath when said blade subassembly is assembled to said hook-shaped lug formation.

4. The combination of claim 3, in which said blade-mounting means is of molded plastic.

5. The combination of claim 3, in which said blade-mounting means includes an elongated guard member offset from and parallel to the cutting edge of said blade, the geometric plane which includes said cutting edge and said guard member defining a relatively more sharply acute angle than the acute angle of said blade with respect to said longitudinal direction when assembled to said hook-shaped lug formation.

6. The combination of claim 5, wherein said contour defines a blade-subassembly support angle with respect to said longitudinal direction, said support angle being intermediate said first and second acute angles.

7. The combination of claim 1, wherein said open side is at the longitudinal sheath end opposite the end having said hook-shaped lug formation.

8. The combination of claim 1, wherein said open side is one of the longitudinally extending sheath sides adjacent the end having said hook-shaped lug formation.

9. In combination, an elongated integral single-piece generally prismatic molded-plastic sheath having a hollow generally prismatic interior open to one of the sides of said sheath, the sectional extent of said open side being of at least the sectional extent of the interior to which access is had via said open side; and a razor-blade subassembly comprising blade means and a rigid back permanently united to and supporting said blade means with at least one elongate straight cutting edge positioned and exposed for a shaving cut, said back defining between front and back faces blade-mounting means at and adjacent to a back edge parallel to said cutting edge, one of said faces having a central locking recess offset from said back edge, the overall length, width and thickness dimensions of said subassembly conforming to the length, width and thickness dimensions of the interior of said sheath, whereby the subassembly is removably insertable in said sheath via said open side; at least one of the longitudinal-end sides of said sheath being closed and including a hooked lug formation of width substantially coextensive with the width dimension of said sheath and defining a razor-mounting opening having an inner-wall contour integrally formed with one longitudinal-end side of said sheath and substantially matching the longitudinally central sectional contour of said subassembly at least at the region thereof which includes said back-edge and at adjacent portions of said front and back faces, the outermost end of said lug formation defining with the opposed inner-wall contour a blade-clamping span which is no greater than the lug-overlapped local effective thickness of said blade-mounting means when the back edge of said blade assembly is received in said hooked lug formation, and said sheath having at the lug-formed end thereof a centrally located integral detent formation projecting within said span and positioned for razor-retaining register with said recess when the longitudinally central back-edge region of said razor-blade subassembly is fitted to said contour.

10. The combination of claim 9, wherein said detent formation is on the part of said contour which is opposite the projecting end of said hook-shaped lug formation.

* * * * *